US007543703B2

(12) United States Patent
Brittain

(10) Patent No.: US 7,543,703 B2
(45) Date of Patent: Jun. 9, 2009

(54) CARTON AND CLIP ASSEMBLY FOR PACKAGING AND SHIPPING A WATER HEATER OR SIMILAR APPLIANCE

(75) Inventor: Jody S. Brittain, North Augusta, SC (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 352 days.

(21) Appl. No.: 11/159,750

(22) Filed: Jun. 23, 2005

(65) Prior Publication Data

US 2006/0289331 A1 Dec. 28, 2006

(51) Int. Cl.
*B65D 85/00* (2006.01)

(52) U.S. Cl. ..... 206/320; 206/446

(58) Field of Classification Search ..... 206/320, 206/321, 326, 446, 448, 449, 451, 453, 454, 206/477, 521, 591, 586, 55, 389, 414
See application file for complete search history.

(56) References Cited

U.S. PATENT DOCUMENTS

| | | | | |
|---|---|---|---|---|
| 2,321,063 | A | 6/1943 | Bohnke | |
| 2,804,253 | A | 8/1957 | Brandt | |
| 2,932,438 | A | 4/1960 | Smith | |
| 2,936,880 | A | 5/1960 | Kohlhaas | |
| 3,107,780 | A | 10/1963 | Stuckert | |
| 3,362,609 | A * | 1/1968 | Freedy | 206/587 |
| 3,752,384 | A | 8/1973 | Siburn | |
| 4,019,672 | A | 4/1977 | Giannini | |
| 4,130,199 | A | 12/1978 | Sorenson | |
| 4,375,261 | A | 3/1983 | Kitchell | |
| 4,919,306 | A * | 4/1990 | Heaps et al. | 222/105 |
| 4,955,474 | A | 9/1990 | Mattingly et al. | |
| 5,509,534 | A * | 4/1996 | Taravella et al. | 206/587 |
| 5,862,911 | A | 1/1999 | Phillips, II et al. | |
| 6,126,002 | A | 10/2000 | Brown et al. | |
| 6,237,838 | B1 | 5/2001 | Bradenbaugh | |

FOREIGN PATENT DOCUMENTS

| | | |
|---|---|---|
| DE | 9310122 | 9/1993 |

OTHER PUBLICATIONS

International Search Report for PCT/US2006/062159 mailed Mar. 15, 2007.

* cited by examiner

*Primary Examiner*—J. Gregory Pickett
(74) *Attorney, Agent, or Firm*—Joel Charlton

(57) ABSTRACT

Disclosed is a positioning and retaining assembly for securing an appliance in a carton that comprises a top cap and bottom pad. The top cap and bottom pad each includes a board and a plurality of clips secured to the board. The clips are arranged to engage the appliance at spaced apart locations around the periphery of the top and bottom of the appliance, respectively. In an alternative embodiment, one of the legs of each top clip has a ledge projecting outwardly from the top clip to engage the top of the appliance. In yet another embodiment, either the top cap or bottom pad can be replaced with a current roll-up design or molded foam, thereby only one of the top cap and bottom pad are used in the positioning and retaining assembly. The assembly is especially useful with water heaters.

14 Claims, 6 Drawing Sheets

CARTON AND CLIP ASSEMBLY FOR PACKAGING AND SHIPPING A WATER HEATER OR SIMILAR APPLIANCE

TECHNICAL FIELD

The present invention generally relates to a packaging assembly and carton for protecting an appliance, such as a water heater, during shipping and handling.

BACKGROUND OF THE INVENTION

Large appliances, e.g., water heaters, are particularly difficult to package to prevent damage during shipping and handling. Typically, large appliances use packaging assemblies that are bulky and take a lot of storage space. Further, the packaging assemblies are usually discarded after the appliances are delivered and cannot be reused. Thus, there is a need in the industry to provide a packaging assembly that is not bulky, saves storage space, is inexpensive and can be reused after delivery.

SUMMARY OF THE INVENTION

Embodiments of the present invention provide a positioning and retaining assembly for packaging appliances in a carton. In one embodiment, an assembly for packaging an appliance in a carton has a top cap and bottom pad each including a board and at least one but preferably a plurality of clips secured to the board. The clips of the top cap and the bottom pad are arranged to engage the appliance at spaced apart locations around the periphery of the top and bottom of the appliance, respectively. Each clip has two legs, with each leg having a foot that projects outwardly from the legs. Each foot is preferably sandwiched between two boards to hold the clip in position. The top and bottom clips are in a generally V-shaped or U-shaped configuration.

In an alternative embodiment, one of the legs of each top clip has a ledge projecting outwardly from the top clip to engage the top of the appliance. In yet another embodiment, either the top cap or bottom pad can be replaced with a current roll-up design or molded foam, thereby only one of the top cap and bottom pad are used in the positioning and retaining assembly. Typically, the roll-up design is a die cut where some assembly by a user is required prior to use.

The positioning and retaining assembly and retained appliance can be enclosed by a carton. The carton includes top, bottom, and side walls, with the positioning and retaining assembly preventing the appliance from contacting the top, bottom and side walls of the carton.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Disclosed is a positioning and retaining assembly for securing an appliance in a carton that comprises a top cap and bottom pad. The top cap and bottom pad each include at least one but preferably at least two boards, which are preferably corrugated, and at least one but preferably a plurality and even more preferably at least three clips secured to the boards. The clips are arranged to engage the appliance at spaced apart locations around the periphery of the top and bottom of the appliance, respectively. The term "appliance" can include, but is not limited to, water heater, refrigerator, washer, dryer, microwave, stove, oven, and outdoor grill. However, the assembly is especially useful with water heaters.

Exemplary positioning and retaining assemblies are discussed with reference to the figures. Although the assemblies are described in detail, the assemblies are provided for purposes of illustration only and various modifications are feasible. The appliance shown in the figures has a cylindrical configuration; however, the appliance can have other cross sectional shapes such as rectangular, square, triangular, or asymmetrical.

Figure 1:
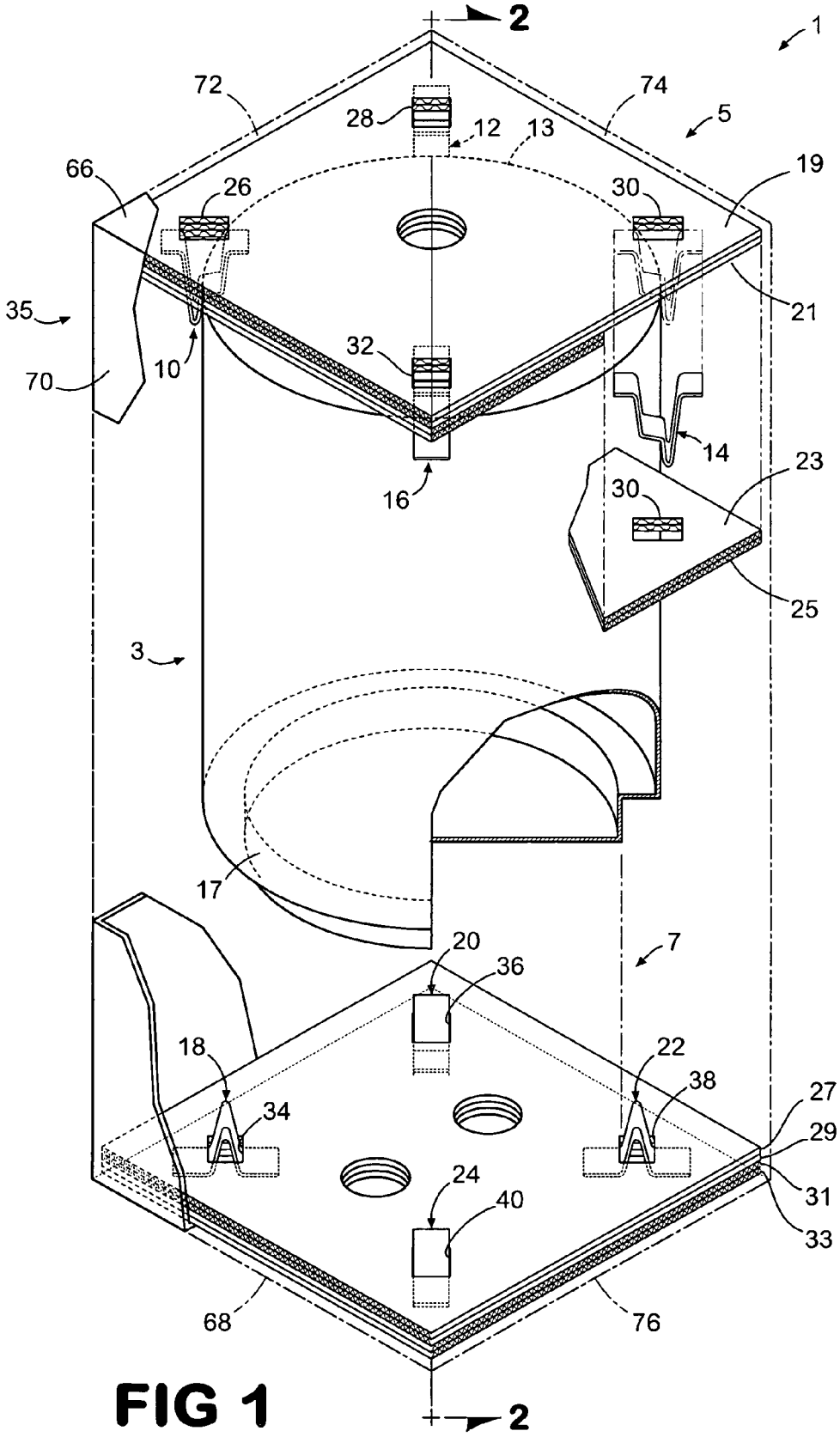
FIG. 1 is an exploded perspective view of an embodiment of a carton with a positioning and retaining assembly for an appliance.

Referring now in more detail to the figures in which like reference numerals identify corresponding parts, FIG. 1 is an exploded perspective view of an embodiment of a carton and positioning and retaining assembly. A packaged appliance 1 is protected by the positioning and retaining assembly that includes a top cap 5 that is positioned on top of appliance 3. The top cap 5 includes corrugated boards 19, 21, 23, 25 that are secured together by, for example, glue or lamination, and top clips 10, 12, 14, 16 that are secured to the corrugated boards 19, 21, 23, 25 through apertures 26, 28, 30, 32, respectively.

The top clips 10, 12, 14, 16 are arranged to engage the appliance 3 at spaced apart locations around the periphery 13 of the top of the appliance 3. A cut out of corrugated boards 23, 25 from the cap 5 is shown in FIG. 1 illustrating the aperture 30 that is formed in the corrugated boards 19, 21, 23, 25. The top clip 14 passes into the aperture 30 in corrugated boards 23, 25 and is secured between the corrugated boards 21, 23. The aperture 30 of corrugated boards 19, 21, 23, 25 enables a plurality of top caps 5 to be nested on top of each other prior to or after use, which is illustrated and described in relation to FIG. 5.

The appliance 3 is positioned and retained on a bottom pad 7 secured with bottom clips 18, 20, 22, 24 that are passed into apertures 34, 36, 38, 40, respectively. The pad 7 is made of corrugated boards 27, 29, 31, 33 that are secured together by, for example, glue or lamination. It should be noted that the corrugated boards 19, 21, 23, 25, 27, 29, 31, 33 of the cap 5 and pad 7 preferably have the direction of the corrugation normal to the adjacent board in the cap 5 or pad 7.

The bottom clips 18, 20, 22, 24 are arranged to engage the appliance 3 at spaced apart locations around the periphery 17 of the bottom of the appliance 3. The bottom clips 18, 20, 22, 24 pass into the apertures 34, 36, 38, 40 of corrugated boards 27, 29, respectively, and are secured between the corrugated boards 29, 31. The apertures 34, 36, 38, 40 of corrugated boards 27, 29, 31, 33 enable a plurality of bottom caps 7 to be nested on top of each other prior to or after use, which is illustrated and described in relation to FIG. 6. The top 10, 12, 14, 16 and bottom 18, 20, 22, 24 clips are spaced apart at least at substantially equidistant locations on the cap 5 and pad 7. While four top clips on the top cap and four bottom clips on the bottom pad are preferred, it is feasible to have only three clips on each cap 5 and pad 7. In addition, while not preferred, fewer than three clips on each cap 5 and pad 7 could be used.

The appliance 3 can be enclosed by a carton 35 in which the positioning and retaining assembly with the retained appliance 3 are positioned. The appliance 3 is secured in carton 35 by the top cap 5 and bottom pad 7. The carton 35 has a top 66, bottom 68 and side walls 70, 72, 74, 76, with the top cap 5 and bottom pad 7 preventing the appliance 3 from contacting the top 66, bottom 68 and side walls 70, 72, 74, 76 of the carton 35.

Figure 2:
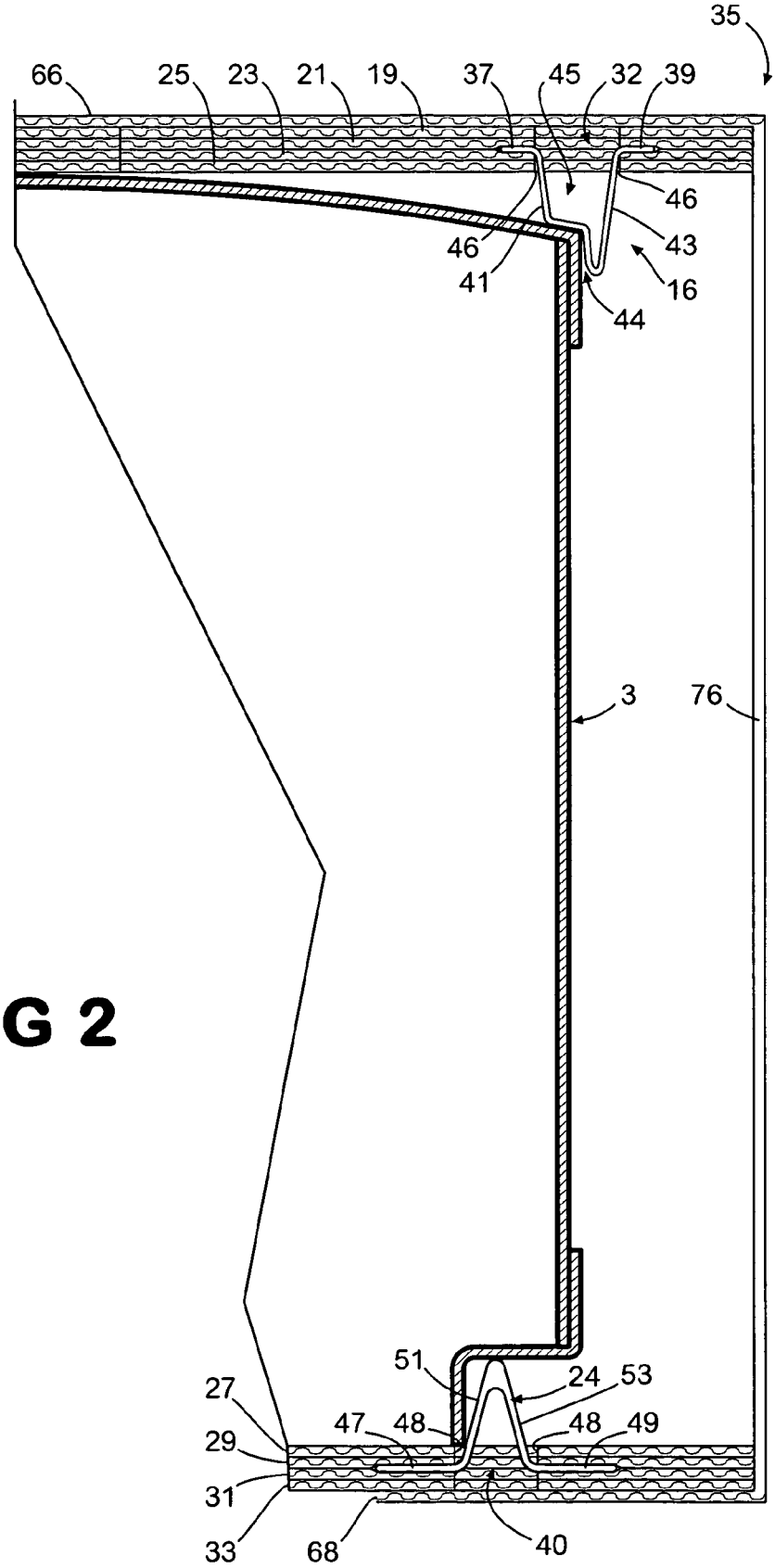
FIG. 2 is a partial cross-sectional view of the embodiment of FIG. 1 along lines 2-2.

FIG. 2 is a partial cross-sectional view of an embodiment of the packaged appliance along lines 2-2 of FIG. 1. The top and bottom clips 16, 24 include respective legs 41, 43, 51, 53 that are arranged in a generally V-shaped configuration. The leg 41 of the top clip 16 has a ledge 45 projecting outwardly from the top clip 16 to engage the top edge 44 of the appliance 3. Each of the legs 41, 43, 51, 53 has a foot 37, 39, 47, 49, respectively, that projects outwardly from the legs 41, 43, 51, 53. The tip of the bottom clip 24 can engage the bottom portion of the appliance 3 as shown in FIG. 2.

The feet 37, 39, 47, 49 of the top and bottom clips 16, 24 are sandwiched between corrugated boards 21, 23 of the cap 5 and corrugated boards 29, 31 of the pad 7, respectively. The top and bottom clips 16, 24 pass into aperture 32 of corrugated boards 23, 25 and aperture 40 of corrugated boards 27, 29 to hold the top and bottom clips 16, 24 in position, respectively. The legs 41, 43, 51, 53 of the top and bottom clips 16, 24 are spaced apart from each other such that the legs 41, 43, 51, 53 are adjacent to the walls 46, 48 of the apertures 32, 40, respectively. The caliper of the corrugated boards 21, 23, 29, 31 can be lowered around the area where the feet 37, 39, 47, 49 of the top and bottom clips 16, 24 reside between the corrugated boards 21, 23 of the cap 5 and corrugated boards 29, 31 of the pad 7, respectively. The reduction of the caliper around these areas gives a recessed area for the feet 37, 39, 47, 49 of the clips 16, 24 so the thickness of the clips 16, 24 does not prevent board-to-board contact of the corrugated boards 19, 21, 23, 25, 27, 29, 31, 33 during the gluing or laminating operation.

Figure 3:
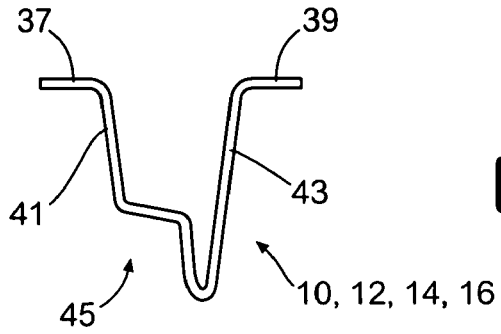
FIG. 3 is a side view of an embodiment of a top clip as shown in FIG. 1.
Figure 4:
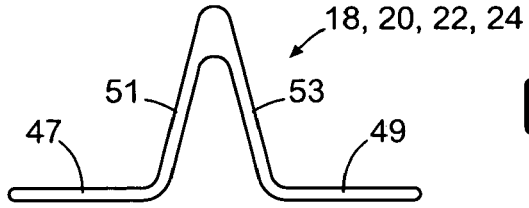
FIG. 4 is a side view of an embodiment of a bottom clip as shown in FIG. 1.

The top clips 10, 12, 14, 16 and bottom clips 18, 20, 22, 24 are further illustrated in FIGS. 3 and 4, respectively, which are side views of an embodiment of the top and bottom clips as shown in FIG. 1. The top clips 10, 12, 14, 16 and bottom clips 18, 20, 22, 24 are preferably constructed of plastic.

In an alternative embodiment, the pad 7 shown in FIGS. 1 and 2 could be used at both the top and bottom of the appliance 3, thereby the pad 7 replaces the top cap 5. In yet another embodiment, the cap 5 shown in FIGS. 1 and 2 could be used at both the top and bottom of the appliance 3, thereby the cap 5 replaces the bottom pad 7. In yet another embodiment, either the top cap 5 or bottom pad 7 can be replaced with a current roll-up design or molded foam, thereby only one of the top cap and bottom pad is used in the positioning and retaining assembly.

One way, among others, to package the appliance 3 is to first place the appliance 3 on the bottom pad 7 and then place the top cap 5 on top of the appliance 3. A strap (not shown) can be used to strap the top cap 5, appliance 3, and bottom pad 7 together. The strapped appliance can then be loaded into the carton 35. Alternatively, the appliance 3 can be placed on the bottom pad 7 and the top cap 5 placed on top of the appliance; the carton 35 can then be placed around the retained appliance 3 and glued together. It should be noted that both ways of packaging the appliance 3 are applicable to the alternative embodiments mentioned above, i.e., pad 7 being used at both the bottom and top of the appliance 3, cap 5 being used at both the bottom and top of the appliance 3, and either the top cap 5 or bottom pad 7 being replaced with a current roll-up design or molded foam.

Figure 5:
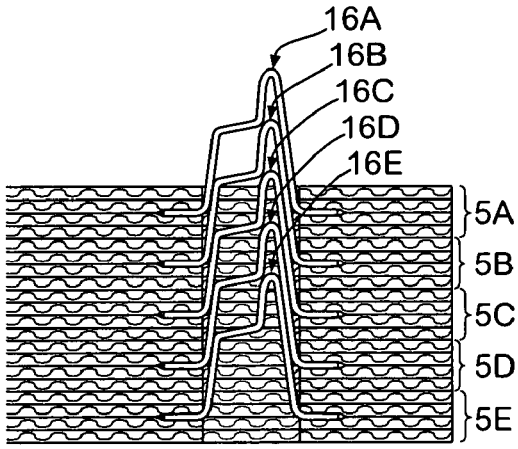
FIG. 5 is a partial side view of a plurality of top caps as shown in FIG. 1 that are nested on top of each other.
Figure 6:
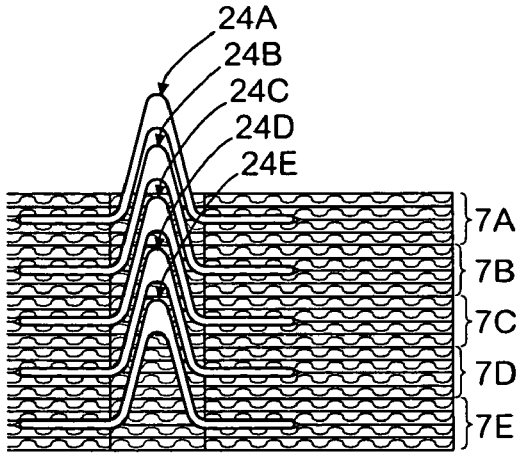
FIG. 6 is a partial side view of a plurality of bottom pads as shown in FIG. 1 that are nested on top of each other.

FIG. 5 is a partial side view of a plurality of the top caps as shown in FIG. 1 that are nested on top of each other. FIG. 6 is a partial side view of a plurality of the bottom pads as shown in FIG. 1 that are nested on top of each other. A plurality of top caps 5 and bottom pads 7 are stackable upon each other, respectively. Referring to FIG. 5, the top clips 16B, 16C, 16D, 16E are nested inside the corresponding clips 16A, 16B, 16C, 16D, respectively, in the top caps 5A, 5B, 5C, 5D immediately above in a stack of top caps 5A, 5B, 5C, 5D, 5E. Referring to FIG. 6, the bottom clips 24B, 24C, 24D, 24E are nested inside the corresponding clips 24A, 24B, 24C, 24D, respectively, in the bottom pads 7A, 7B, 7C, 7D immediately above in a stack of bottom pads 7A, 7B, 7C, 7D, 7E.

Figure 7:
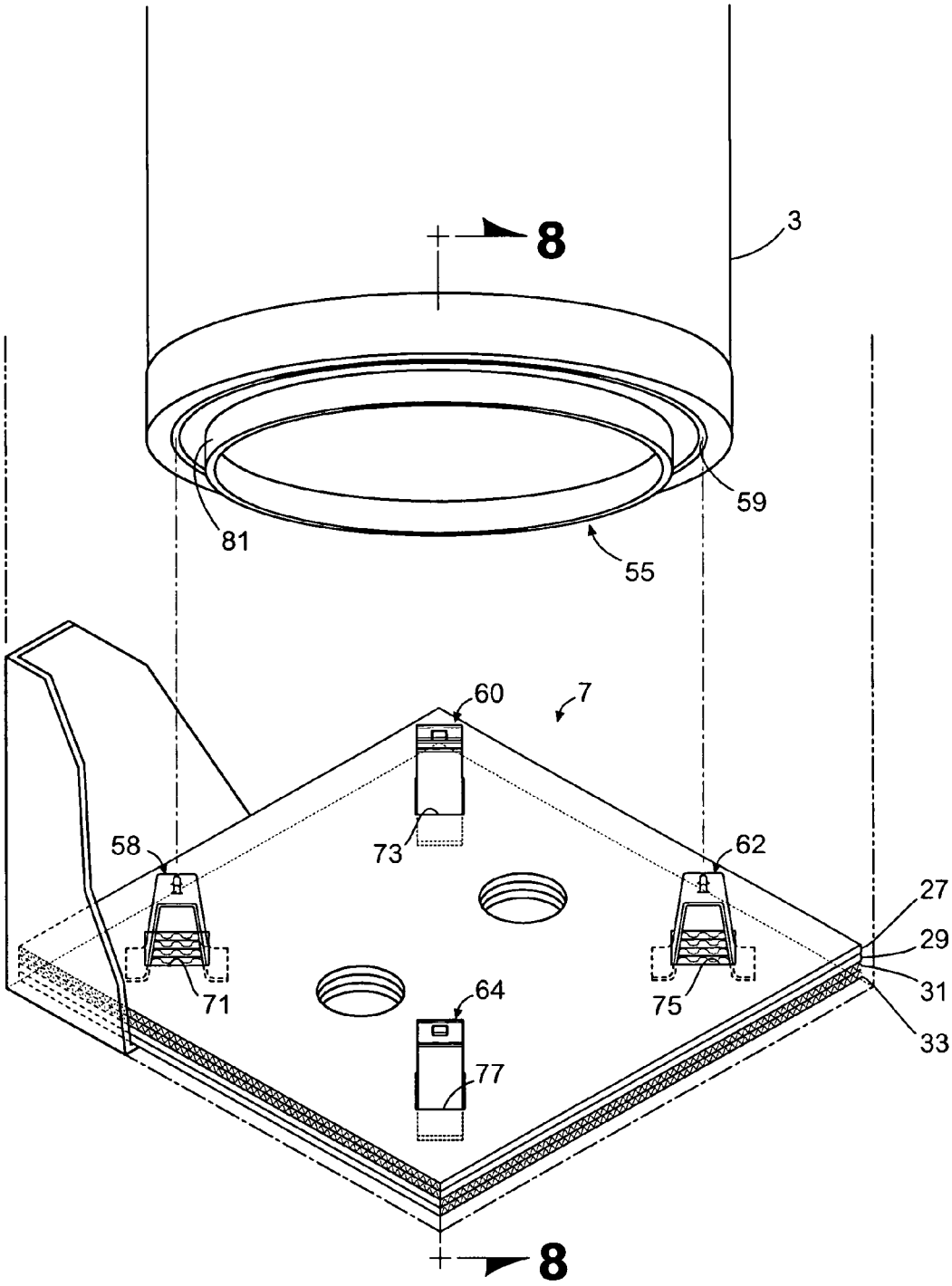
FIG. 7 is an exploded partial perspective view of an embodiment of the lower portion of the positioning and retaining assembly as shown in FIG. 1 where the bottom pad includes bottom clips with a projection on the top of the clip engaging a recess.

FIG. 7 is an exploded partial perspective view of an embodiment of the lower portion of the packaged appliance as shown in FIG. 1, where the bottom pad includes bottom clips with a projection on top of each clips. In this embodiment, the appliance 3 is placed inside a retained base pan 55, thus positioning and retaining the bottom portion of the appliance 3. The bottom clips 58, 60, 62, 64 are arranged at spaced apart locations around the bottom periphery 81 of the base pan 55. Each of the bottom clips 58, 60, 62, 64 includes a projection 61 on its top 79 (shown in FIG. 8) that engages a recessed portion 59 of the base pan 55 to hold the base pan 55 in a retained position. The recessed portion 59 may be a circular groove disposed at the bottom of the base pan 55. It should be noted that other shapes of the groove are applicable such as rectangular, square, triangular, or asymmetrical.

Figure 10:
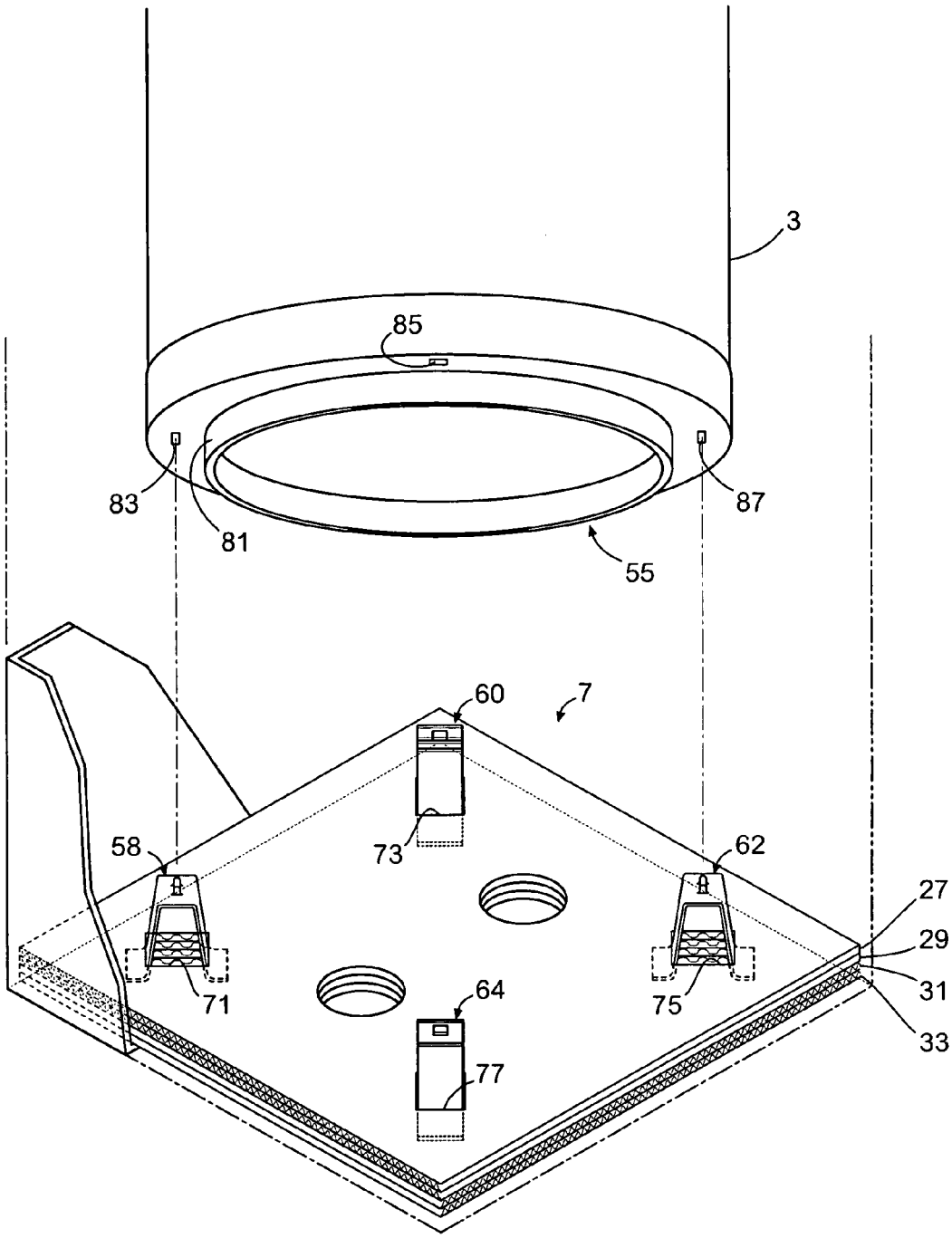
FIG. 10 is an exploded partial perspective view of an embodiment of the lower portion of the positioning and retaining assembly as shown in FIG. 1 where the bottom pad includes bottom clips with a projection on the top of the clip engaging a slot.

In an alternative embodiment, the projection 61 of bottom clips 58, 60, 62, 64 engages a slot 83, 87, 85, respectively, as shown in FIG. 10. Each slot 83, 85, 87 is a cut-out of the bottom of the base pan 55. The embodiments of the recessed portion 59 and the slots 83, 85, 87 maintain the appliance 3 in a desired distance between the outside of the appliance 3 and the side walls of the carton 35. The embodiment of using the slots 83, 85, 87 further prevents the appliance 3 from rotating within the carton 35.

The bottom clips 58, 60, 62, 64 in both embodiments shown in FIGS. 7 and 10 pass into the apertures 71, 73, 75, 77 of corrugated boards 27, 29, respectively, and are secured between the corrugated boards 29, 31. The apertures 71, 73, 75, 77 of corrugated boards 27, 29, 31, 33 enable a plurality of bottom caps to be nested on top of each other prior to or after use, which is illustrated and described in relation to FIG. 9. The base pan 55 is shown to have a circular shape; however, the base pan 55 can have other shapes such as rectangular, square, triangular, or asymmetrical.

Figure 8:
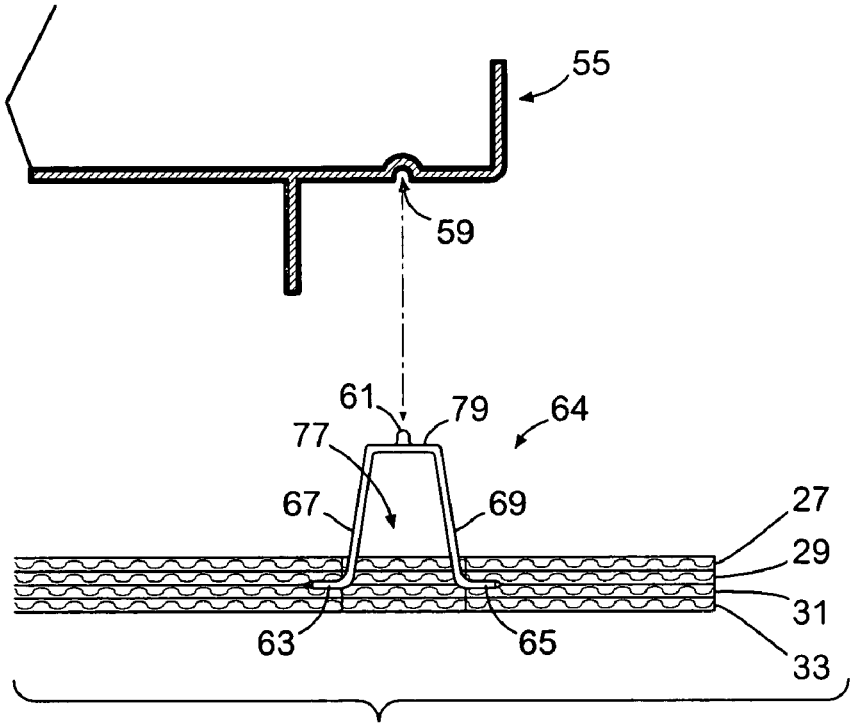
FIG. 8 is an exploded partial side view of the embodiment of FIG. 7.

FIG. 8 is an exploded partial side view of an embodiment of the lower portion of the packaged appliance as shown in FIG. 7. The bottom clip 64 includes base or top 79 and legs 67, 69, that are arranged in a generally U-shaped configuration. The base or top 79 of the bottom clip 64 has a projection 61 projecting outwardly from the bottom clip 64. Each of the legs 67, 69 has a foot 63, 65 that projects outwardly from the legs 67, 69, respectively. Each foot 63, 65 is sandwiched between corrugated boards 29, 31 of the pad 7 through aperture 77 of corrugated boards 27, 29, respectively, to hold the bottom clip 64 in position. The projection 61 is remote from the ends of the legs to which the feet 63, 65 are attached for engaging the recessed portion 59 of the base pan 55.

Figure 9:
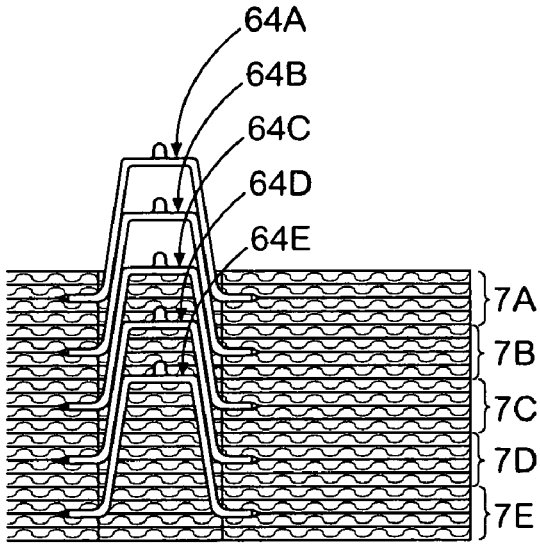
FIG. 9 is a partial side view of a plurality of the bottom pads as shown in FIG. 7 that are nested on top of each other.

FIG. 9 is a partial side view of an embodiment of the bottom pads as shown in FIG. 7 that are nested on top of each other. A plurality of the bottom pads 7 are stackable upon each other. The bottom clips 64B, 64C, 64D, 64E are nested inside the corresponding clips 64A, 64B, 64C, 64D, respectively, in the bottom pads 7A, 7B, 7C, 7D immediately above in a stack of bottom pads 7A, 7B, 7C, 7D, 7E.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A positioning and retaining assembly for securing an appliance in a carton comprising:

a. a top cap including at least two corrugated boards which are secured together and at least three top clips secured to the boards and arranged to engage the appliance at spaced apart locations around the periphery of the top of the appliance, each said top clip having two legs with a foot on each leg that projects outwardly from the legs, each foot being sandwiched between two corrugated boards in the cap to hold the top clip in position; and b. a bottom pad including at least two corrugated boards which are secured together and at least three bottom clips secured to the pad and arranged to engage the appliance at spaced apart locations around the periphery of the bottom of the appliance, each said bottom clip having two legs with a foot on each leg that projects outwardly from the legs, each foot being sandwiched between two corrugated boards in the pad to hold the bottom clip in position.

2. The positioning and retaining assembly of claim 1 for packaging a water heater with circular side walls, in which the corrugated boards of the cap and pad are secured together by glue or lamination and in which the cap and pad each has four clips that are spaced apart at least at substantially equidistant locations.

3. The positioning and retaining assembly of claim 2, in which the top and bottom clips are in a generally V-shaped or U-shaped configuration.

4. The positioning and retaining assembly of claim 2, in which each bottom clip has a projection remote from the ends of the legs to which feet are attached for engaging a recess or a slot on the bottom portion of the water heater to hold the water heater in a retained position.

5. The positioning and retaining assembly of claim 1, in which the top and bottom clips are constructed of plastic.

6. The positioning and retaining assembly of claim 1, in which one of the legs of the top clip includes a ledge projecting outwardly from the clip to engage the periphery of the top of the appliance.

7. The positioning and retaining assembly of claim 1, in which one of the legs of the bottom clip includes a ledge projecting outwardly from the clip to engage the periphery of the bottom of the appliance.

8. The positioning and retaining assembly of claim 2, in which a plurality of caps are stackable upon each other with the top clips of one cap being nested inside the corresponding clips in the cap immediately above said cap in a stack of caps, and a plurality of pads are stackable upon each other with the bottom clips of one pad being nested inside the corresponding clips immediately above said pad in a stack of pads.

9. A protective shipping and storage package for an appliance comprising:

a. a positioning and retaining assembly comprising:

i. a top cap including at least two corrugated boards which are secured together and at least three top clips secured to the boards and arranged to engage the appliance at spaced apart locations around the periphery of the top of the appliance, each said top clip having two legs with a foot on each leg that projects outwardly from the legs, each foot being sandwiched between two corrugated boards in the cap to hold the top clip in position; and ii. a bottom pad including at least two corrugated boards secured together and at least three bottom clips secured to the boards and arranged to engage the appliance at spaced apart locations around the periphery of the bottom of the appliance, each said bottom clip having two legs with a foot on each leg that projects outwardly from the legs, each foot being sandwiched between two corrugated boards in the pad to hold the bottom clip in position; and a carton in which said positioning and retaining assembly with the retained appliance is to be positioned.

10. The protective shipping and storage package of claim 9 for packaging a water heater with a circular cross section, in which the corrugated boards of the cap and pad are secured together by glue or lamination and in which the cap and pad each has four clips that are spaced apart at least at substantially equidistant locations.

11. The protective shipping and storage package of claim 10 in which the top and bottom clips are constructed of plastic and are in a generally V-shaped or U-shaped configuration.

12. The protective shipping and storage package of claim 9 in which each bottom clip has a projection remote from the ends of the legs to which the feet are attached for engaging a recess or a slot in the bottom portion of the appliance to hold the appliance in a retained position.

13. The protective shipping and storage package of claim 9 in which one of the legs of the top clip includes a ledge projecting outwardly from the top clip to engage the periphery of the top of the appliance.

14. The protective shipping and storage package of claim 9 in which the carton contains said appliance secured by said positioning and retaining assembly, said carton having a top, bottom and side walls, with the positioning and retaining assembly preventing the appliance from contacting the top, bottom and side walls of the carton.

* * * * *